United States Patent [19]

Boots

[11] 3,974,725

[45] Aug. 17, 1976

[54] HIGH VOLUME CUTTER FOR ELONGATE FOOD PRODUCTS

[75] Inventor: Vernie A. Boots, Belle Glade, Fla.

[73] Assignee: A. Duda and Sons, Oviedo, Fla.

[22] Filed: July 8, 1974

[21] Appl. No.: 486,311

[52] U.S. Cl. ..... 83/100; 83/155; 83/354; 83/356.3; 83/420; 83/422; 100/97; 241/281

[51] Int. Cl.[2] ..... B26D 1/28; B26D 7/06

[58] Field of Search ..... 83/354, 100, 356.3, 83/355, 420, 422, 19, 409.2, 155, 409.1; 241/280, 281, 223, 222; 100/151, 97, 152, 154

[56] References Cited

UNITED STATES PATENTS

| | | | |
|---|---|---|---|
| 383,494 | 5/1888 | Schmid | 83/354 |
| 2,310,358 | 2/1943 | Emmons et al. | 83/420 X |
| 3,511,122 | 5/1970 | Sherrill et al. | 83/422 X |
| 3,605,541 | 9/1971 | Ruben et al. | 83/355 |

*Primary Examiner*—Frank T. Yost
*Attorney, Agent, or Firm*—Julian C. Renfro

[57] ABSTRACT

A machine for cutting or slicing celery, carrots, or other elongate vegetables into pieces of selected size, accomplished on a rapid and highly economical basis. My machine utilizes a plurality of endless, moving belts, with one of the belts being arranged to receive vegetables deposited thereon, and to transport same to a location adjacent what may be regarded as the terminus of the belt. Mean such as other moving belts are utilized for gradually applying pressure to the vegetables during their travel along the length of the vegetable-supporting belt, thus to accomplish a compression of such vegetables into a tightly compacted mass. High speed cutter means operative adjacent the terminus serve to cut the vegetables into small pieces, with the size of the pieces being determined by the speed of the cutter relative to the velocity of the belts.

8 Claims, 9 Drawing Figures

HIGH VOLUME CUTTER FOR ELONGATE FOOD PRODUCTS

BACKGROUND OF THE INVENTION

It is of course old in the art to provide machines for accomplishing a mechanical cutting of celery, carrots, and the like, and one popular machine of this general type utilizes a pair of endless moving belts disposed together so as to define an essentially V-shaped trough. Celery or carrots placed in such trough are carried one at a time through a cutting process, and although that type of arrangement is in widespread use, is fraught with numerous disadvantages. For example, that type of machine is limited to dealing with only limbs of a stalk of celery, so this of course requires that the limbs be stripped from the stalk before they are fed into that type of machine. There is a further requirement that the limbs be properly oriented as they are placed in the machine, which requires either additional complexity on the part of the machine, or else additional hand labor. As a result of these and other factors, it has in the past been quite expensive to slice elongate vegetables and this has, to a large extent, kept such products from being widely available on the shelves of grocery stores.

SUMMARY OF THIS INVENTION

In contrast to the very limited, low volume cutting arrangements of the prior art, I have provided herein a high speed cutting arrangement having no requirements of pretrimming or orientation of the product to be sliced, and as a result of novel constructional and operational techniques, I have been able to provide a truly high volume machine that makes possible an entirely new outlook to food processers, concerned with items such as celery, carrots and other such food products.

Advantageously, I provide a multi-belt arrangement involving an endless moving belt upon which vegetables are to be deposited and carried to a location to be cut into pieces of desired size. Bounding the support belt are other endless belts moving in the same direction and at essentially the same speed as the supporting belt, with these other belts being disposed so as to gradually move the vegetables together. In the event elongate vegetables such as celery and carrots are involved, this procedure serves to dispose the vegetables into a longitudinally aligned arrangement, such that the vegetables can pass through a comparatively narrow throat near the extreme end or terminus of the belts. Vibrational techniques may be utilized in connection with certain of the belts, to aid in the alignment process.

Thus, my multiple belt arrangement in effect surrounds the vegetables, with these belts being positioned so as to gradually constrict and compress the volume of vegetables into a mass that can be cut up at a very rapid rate by a rotary cutter residing at the outlet of the throat, adjacent the terminus of the belts.

A wide range of cutter speeds and belt speeds are available and by establishing a desired relationship between the rotary speed of the cutter and the lineal speed of the belts, pieces of vegetable of preascertained, consistent size may be cut.

This type of machine is to be distinguished from the low volume machines of the prior art, which displayed no recognition of the novel techniques set forth herein that involve a rapidly rotating cutter arranged to act upon vegetables that have first been properly compressed into an aligned mass, which compression is accomplished without crushing the vegetables.

As should be apparent, there is no requirement on the part of the operator of my machine insofar as any pre-alignment of elongate vegetables is concerned, for the gradual narrowing of the space between the moving belts, coupled with a desirable amount of vibration, serves to align the elongate vegetables in such a manner that they can easily pass through the narrow throat and be acted upon by the rapidly rotating cutter.

It is therefore a principal object of my invention to provide a high volume machine for cutting and slicing celery, carrots, and other elongate food products into pieces of a desired size and in a very economical and efficient manner.

It is another object of my invention to provide a slicing machine to which can be delivered considerable quantities of an elongate vegetable, which will proceed to automatically align the vegetables in a desirable configuration, and then slice such vegetables in an efficient and high speed manner, to a consistent size.

It is still another object of my invention to provide a high speed slicing machine utilizing a plurality of endless belts which serve to align, compress and pack vegetables into what may be regarded as a self-supporting mass that can be effectively acted upon by a high speed cutter, thus making it possible to cut up vegetables of this type at a much faster rate and much more economically than has ever previously been possible.

These and other objects, features and advantages will be more apparent from the appended drawings, in which.

DETAILED DESCRIPTION

Figure 1:
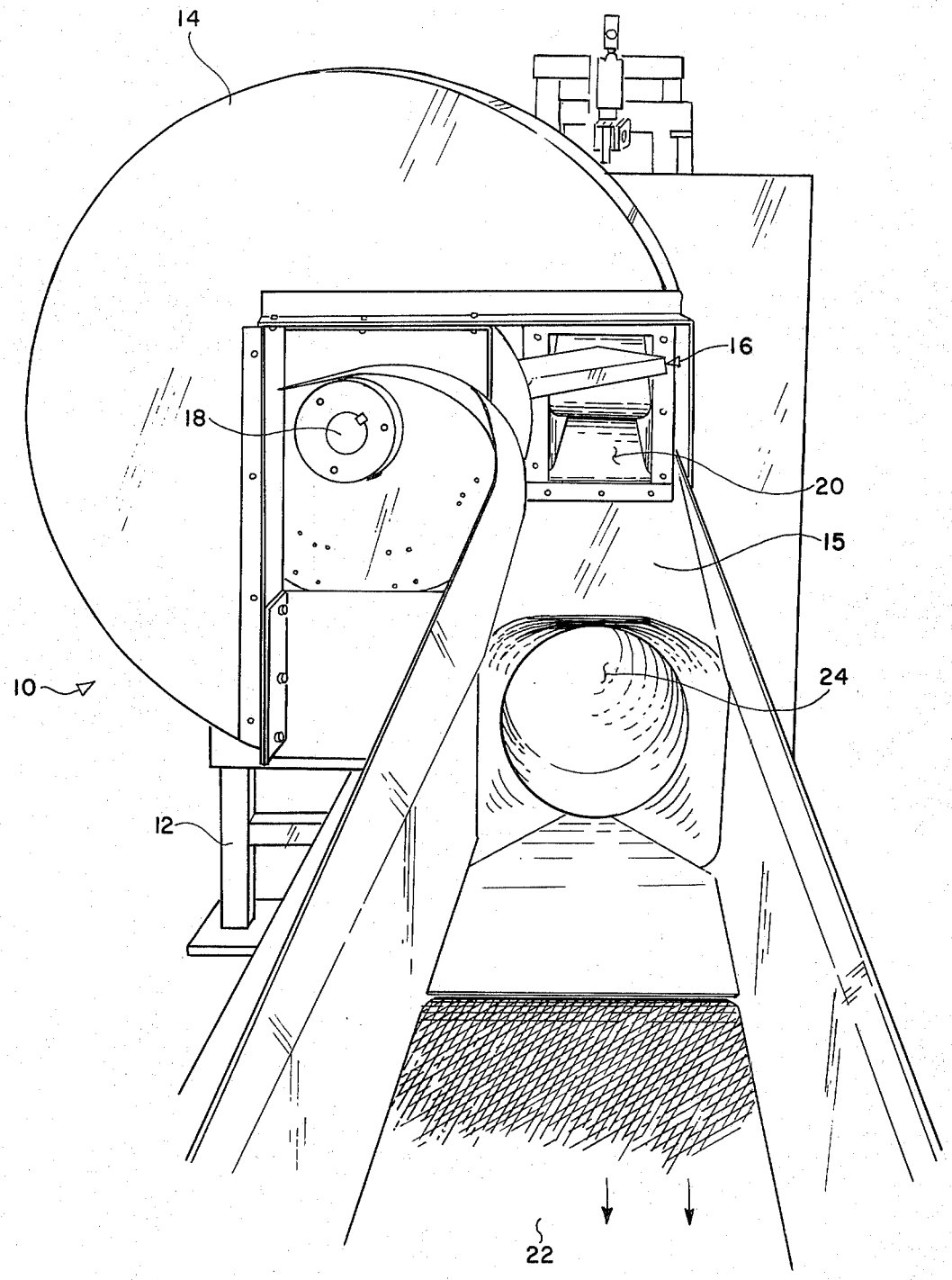
FIG. 1 is a perspective view of the rear or discharge side of my machine, illustrating the opening through which the compressed vegetables are discharged from the belt array, and the rotating cutter arrangement serving to cut the mass of vegetables into pieces of desired size.

Turning to FIG. 1, it will there be seen that I have provided a novel high speed cutting machine 10 involving a base 12, upon the rear portion of which a circular housing 14 is mounted in an essentially vertical position. In the circular housing a multibladed cutter 16 is mounted upon rotatable shaft 18. This rotary cutter serves to cut into small pieces, the celery, carrots or other vegetables emerging from the discharge opening 20.

Since the cutting device operates at high speed, the sliced pieces of vegetable emerge at a considerable velocity and fall upon a moving mesh belt 22, whose direction of movement is away from the opening 20, and toward the location (not shown) at which further processing will take place. Leaves and other debris falling from the opening 20, because of their weight in relation to their surface area, are pulled into opening 24, which is the inlet to a tube 26, best seen in FIG. 8, in which a low pressure is maintained by an exhaust fan (not shown) that serves to transport the debris to a point of disposal. The flow of air into the opening 24 is sufficiently large as to carry the leaves into the tube 26, but not sufficiently large as to attract anything but a scant amount of the sliced vegetable. A number of the components mentioned above will be shown in detail and described at length hereinafter.

Figure 2:
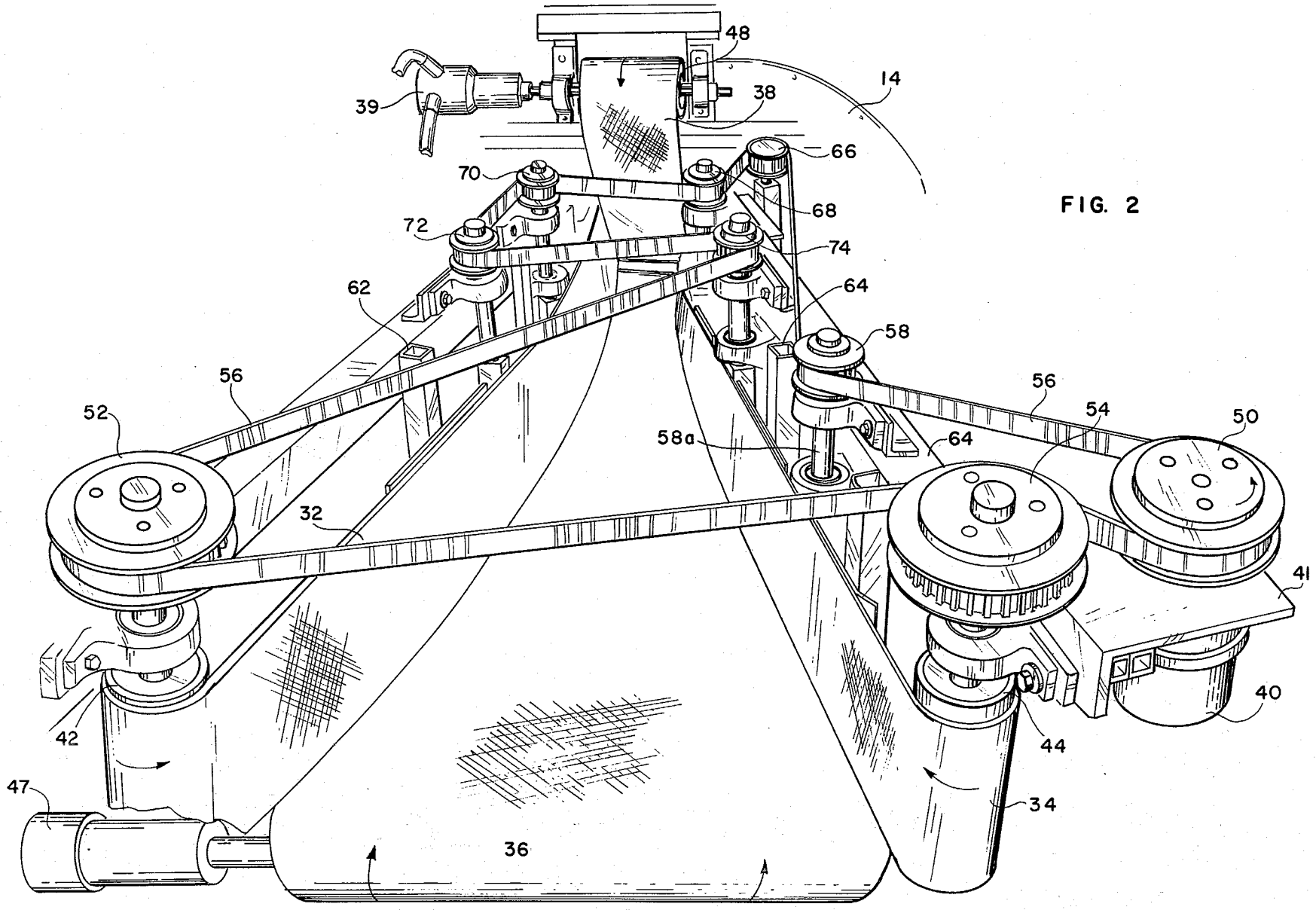
FIG. 2 is a perspective view taken from the forward or intake portion of my machine, so as to reveal the endless belt upon which vegetables are deposited, as well as the belts that cooperate with the supporting belt, and the drive means for the belts.

The discharge opening or throat 20 for the cut up vegetables is the terminus of several moving belts that serve to convert the celery or other vegetables from a loose form, into a compressed, properly oriented, essentially self-supporting form such as can be effectively acted upon by the rotating high capacity cutter 16. FIG. 2 reveals a preferred arrangement of endless conveyor belts, involving a moving belt 32 on the left side of FIG. 2, a moving belt 34 on the right side of FIG. 2, a lower belt 36 that supports the vegetables to be cut, and an upper belt 38 that is instrumental in the proper compressing of the vegetables, and in assuring the uniform velocity thereof.

The upper end of belt 38 is supported by a drum or drive pulley 48 directly driven by a motor 39, typically a hydraulic motor, and belts 32 and 34 are driven by a motor 40 which is also preferably a hydraulic motor, whose output is carried to the input drums 42 and 44 associated with belts 32 and 34 by means of a cog (non-slip) drive belt 56 of considerable length. As will be later discussed, the belt 56 drives the drums 42 and 44 by respectively interacting with pulleys 52 and 54, whose active surfaces are notched to receive the raised portions (or teeth) that are disposed in spaced relation along both sides of the belt 56. Proper tension in belt 56 is obtained by manipulation of an idler adjustment means 67 associated with idler pulley 66; see FIG. 5. The lower belt 36 is directly driven by a motor 47.

The inner or active surfaces of the conveyor belt, that is, the surfaces of belts 32, 34, 36 and 38 nearest the vegetables travel in the same direction, that is, toward the outlet 20, and at the same speed in transporting the vegetables to be cut by the cutter 16.

In order to have all of the belt portions that contact the vegetables move at the same speed, I abide by several constructional and operational criteria, such as utilizing a common source of hydraulic fluid for driving the motors 39, 40 and 47; operating these motors in series; selecting motors of the same cubic inch displacement for powering the belts; and utilizing drive drums of the same diameter for driving the belts 32, 34, 36 and 38. As a result, I have to take no special precautions in order to have these four belts travel at the same speed. Typically, I utilize hydraulic pressure at 1200 psi, and the volume is typically 10 gallons per minute.

In addition to the compression of the vegetables achieved by having the upper moving belt 38 apply a degree of downward pressure, the belts 32 and 34 are each disposed at an angle to the centerline of the lower belt 36, or in other words, the vegetable-contacting sides of the belts come closer together as they travel toward the discharge opening 20. Because of this, the vegetables deposited at a forward or first location on the lower belt 36 will be compressed in a sideways sense during travel to a second or terminus location, as a result of contact with the upstanding inner active surfaces of the belts 32 and 34.

Figure 3:
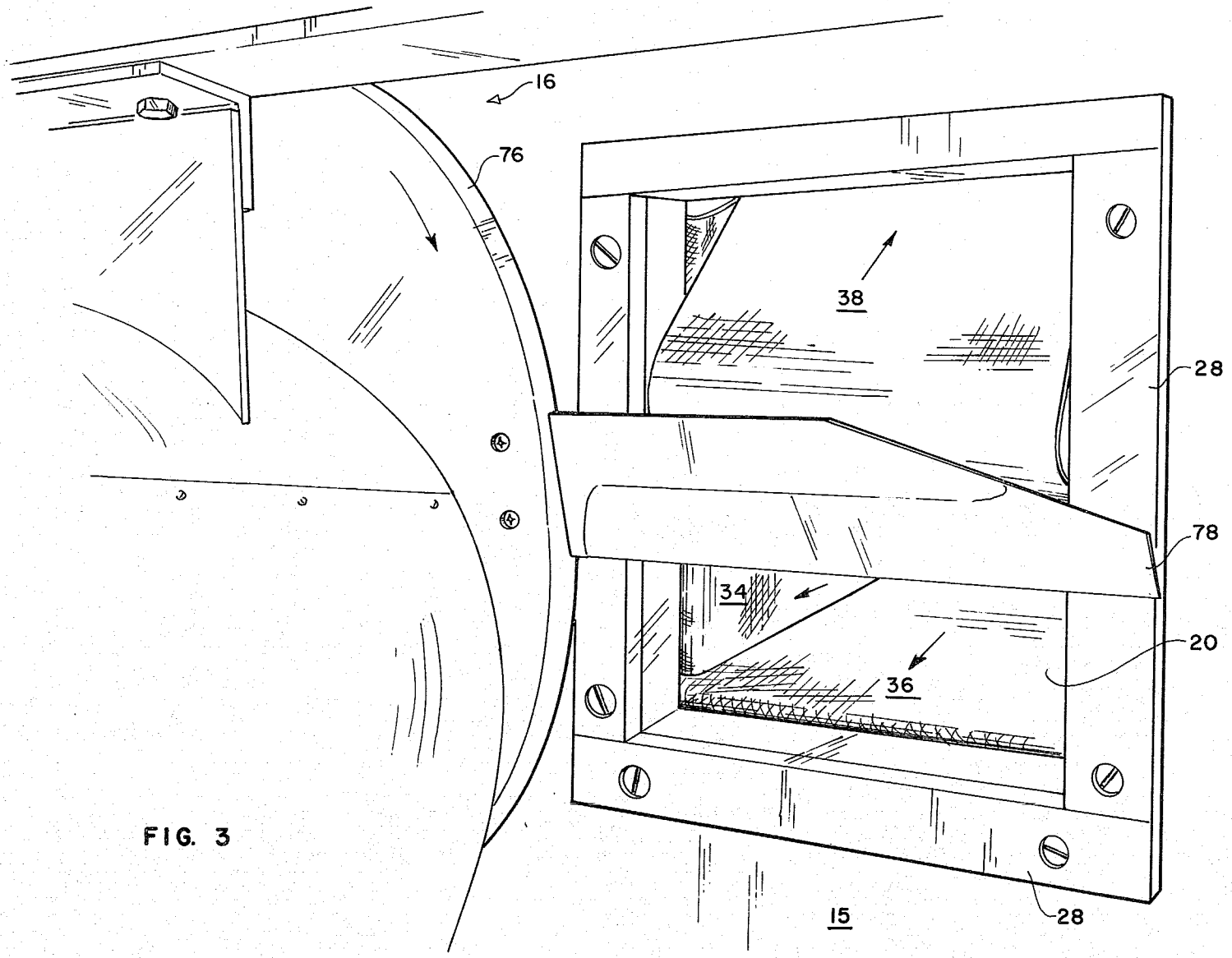
FIG. 3 is a view from the rear or discharge side of the machine, taken to a larger scale so as to reveal the cooperating endless belts that deliver the compacted vegetables to the discharge opening, and the relationship of the high speed cutter to the discharge opening, such that the slicing of the vegetables can be selectively accomplished.

It is to be noted, such as from FIG. 3, that the distance between the end surfaces at the terminus of the left and right belts is essentially the same as the distance between the left and right sides of opening 20. For example, although the distance between driving drum 42 associated with moving belt 32, and the driving drum 44 associated with moving belt 34 may be 24 inches, by the time the terminus location is reached, the distance between the inner surfaces of the belts 32 and 34 at a location immediately adjacent the outlet opening or throat may be 6 inches. The lower inner portions of the endless belts 32 and 34, that is, the portions of these belts that at any moment are disposed above the lower belt 36, are slightly spaced therefrom in a vertical sense, with the clearance being small in order to prevent spillage of the vegetable. Since the surfaces defining the inner active portions of belts 32 and 34 are much closer together near the throat or opening 20 than near the drive motor 40, this of course means that the vegetables resting on substantially the full width of the belt 36 near the motor 40 will be compressed by belts 32 and 34 in traveling toward the throat 20, as previously mentioned, and for this reason will be residing on just a small central portion of the width of the belt 36 when the belt terminus, or in other words, near the opening 20. The width of upper belt 38 is such as not to interfere with the operation of belts 32 and 34. As an example the belt 38 can be 6″ wide; the belts 32 and 34 9¾″ high; and belt 36 18″ wide.

Lengthwise travel of the vegetable-contacting portions of belts 32 and 34 toward the throat 20 is brought about, as previously mentioned, by the use of the cog belt 56, which is a continuous belt deriving its motion by passing around motor output pulley 50 in driving engagement therewith. The motor 40 is supported by a bracket 41 that in turn is supported by a framework 64 that forms the support for a number of components associated with the right belt 34. A comparable framework 62 is associated with the left belt 32.

Numerous bar-like members are disposed in spaced relation along the length of both sides of the belt 56, and the active surface of the drive pulley 50 is notched around its periphery so as to engage the bar-like members disposed about the inner portion of the belt. The endless belt 56 is stretched about a number of pulleys, both idler pulleys and vibrator pulleys, each of a configuration to mesh with belt 56, as will be noted from a careful inspection of FIG. 2. For example, after passing around the drive pulley 50, the belt 56 goes around the idler pulley 58 that is disposed on a vertically rotatable shaft 58a mounted on the framework 64 relatively close to the motor 40. Thereafter, the belt 56 passes around the idler pulley 66 that is disposed relatively near the opening 20, thence around the vibrator pulley 68 and the vibrator pulley 70, latter devices being on opposite sides of the belts 34 and 32, respectively. Pulleys 68 and 70 are mounted on vertically rotatable shafts (not shown), and on the lower ends of these shafts are disposed shaft portions of square cross section that are in contact with the remote or nonvegetable-contacting portions of the belts 32 and 34 for essentially their full height. Since these portions of square cross section cannot rotate in continuous contact with the respective belts, they create a vibratory movement in the belts as they rotate, this serving to cause the vegetables contacting belts 32 and 34 to vibrate and to be shifted into a longitudinal orientation or alignment suitable for being acted upon by the cutter.

After passing around pulley 70, the endless belt 56 passes around pulley 72 that is associated with another vibrator for belt 32, and thence around pulley 74, associated with another vibrator for belt 34. After going around pulley 74, the cog belt 56 passes around the belt drive pulley 52, that serves to drive the drum 42 in rotation, latter drum causing the motion of endless belt 32, and thereafter passes around belt drive pulley 54, that serves to drive drum 44 in rotation, which of course in turn causes the motion of endless belt 34. As a result of the active surfaces of pulleys 52 and 54 being notched so as to receive the bar-like members on each side of belt 56 in the proper driving relationship, slippage of the drive belt is effectively prevented.

Turning to FIG. 3, the relationship of the cutter 16 to the members 28 disposed around four sides of the rear of opening 20, and to the conveyor belts will be more apparent. The cutter 16 is constituted by a rotatable circular member 76, upon which a plurality of essentially straight blades 78 are mounted in a relationship such that they are spaced evenly about the periphery of member 76. The member 76 may for example be twenty inches in diameter, and as viewed in FIG. 3, rotates in a clockwise direction. The opening or throat 20 in FIG. 3 may be say 6¼ inches wide, and in such instance, the blade 78 may extend out say 8½ inches beyond the rim of the member 76, and in that way be assured that it will be of sufficient length to cut all of the vegetables being forced out of the opening 20 by the combined action of the endless conveyor belts. Portions of belts 34, 36 and 38 will be noted to be visible in this figure.

A definite relationship must exist between the motion of the conveyor belts and the rotation of the cutter blades in order that the vegetables, such as celery, carrots or the like will be sliced into the desired lengths. Depending on the speed of the belts and of the member 76, from one to eight blades 78 may be used, with an even and symmetrical relationship of blades being highly desirable if not mandatory. When only a single blade is used, the use of a counterweight is typical. The relative speed of the conveyor belts and the rotary cutter will be discussed hereinafter.

Figure 4:
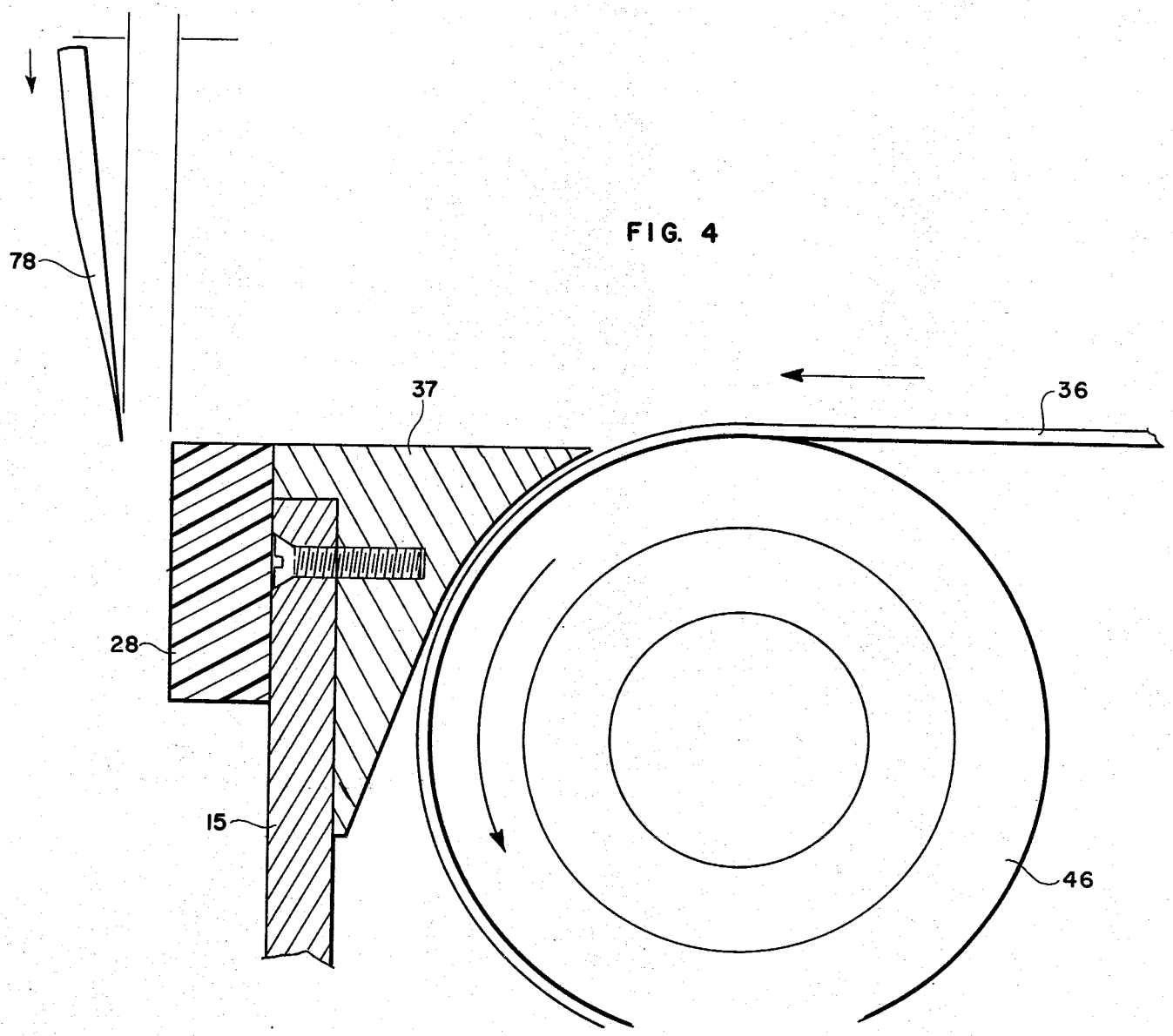
FIG. 4 is a cross-sectional view revealing the relationship of the cutter blade to the opening as well as the relationship of the moving belt to the opening.

Reference to the large scale showing of FIG. 4 reveals that the sharpened lower edge of the blade 78 passes very close to the member 28 defining the lower edge of the opening 20, typically being spaced from ⅛ inch to 3/16 inchfrom this member 28. However, it is also to be noted from this figure that the upper edge of the blade 78 is spaced further from the plane of the member 28 than is the lower edge, this being the preferred arrangement in view of the fact that the vegetables are continuously moving during the time the cutter is rotating, and the spacing of the upper part of the blade away from the opening, even though very slight, is sufficient to prevent undesirable contact of the vegetables with the upper part of the blade.

It is to be noted from FIG. 4 that a generally triangular-shaped member 37 is provided closely adjacent the belt 36, at the location where it turns and passes around the drive roller 46. This triangular-shaped member, made for example of brass, is of a length approximately equal to the width of the belt 36, and is closely spaced therefrom in order to prevent portions of celery or other vegetable from passing between the member and the roller. As will be noted from this figure, the interior curvature of the member 37 essentially matches the curvature of the roller, thus making it possible for the upper edge of the member 37 to be close to the belt 36, and of a height essentially corresponding to the height of the belt. Support for the member 37 is provided by front structural member or plate 15, with screws or other fasteners being utilized for securing the triangular-shaped member to the structural member. The plate 15 is of substantial construction, typically of ½ inch steel plate that is welded to the tubular members 12 of the base.

As mentioned in connection with FIG. 3, I prefer to use a plurality of members 28 about the opening 20, with only the lower one of these members being shown in cross-section in FIG. 4. This material is typically of an ultra high molecular weight polyolefin such as polypenco 19, made by Polymer Corporation of Reading, Pennsylvania.

Figure 5:
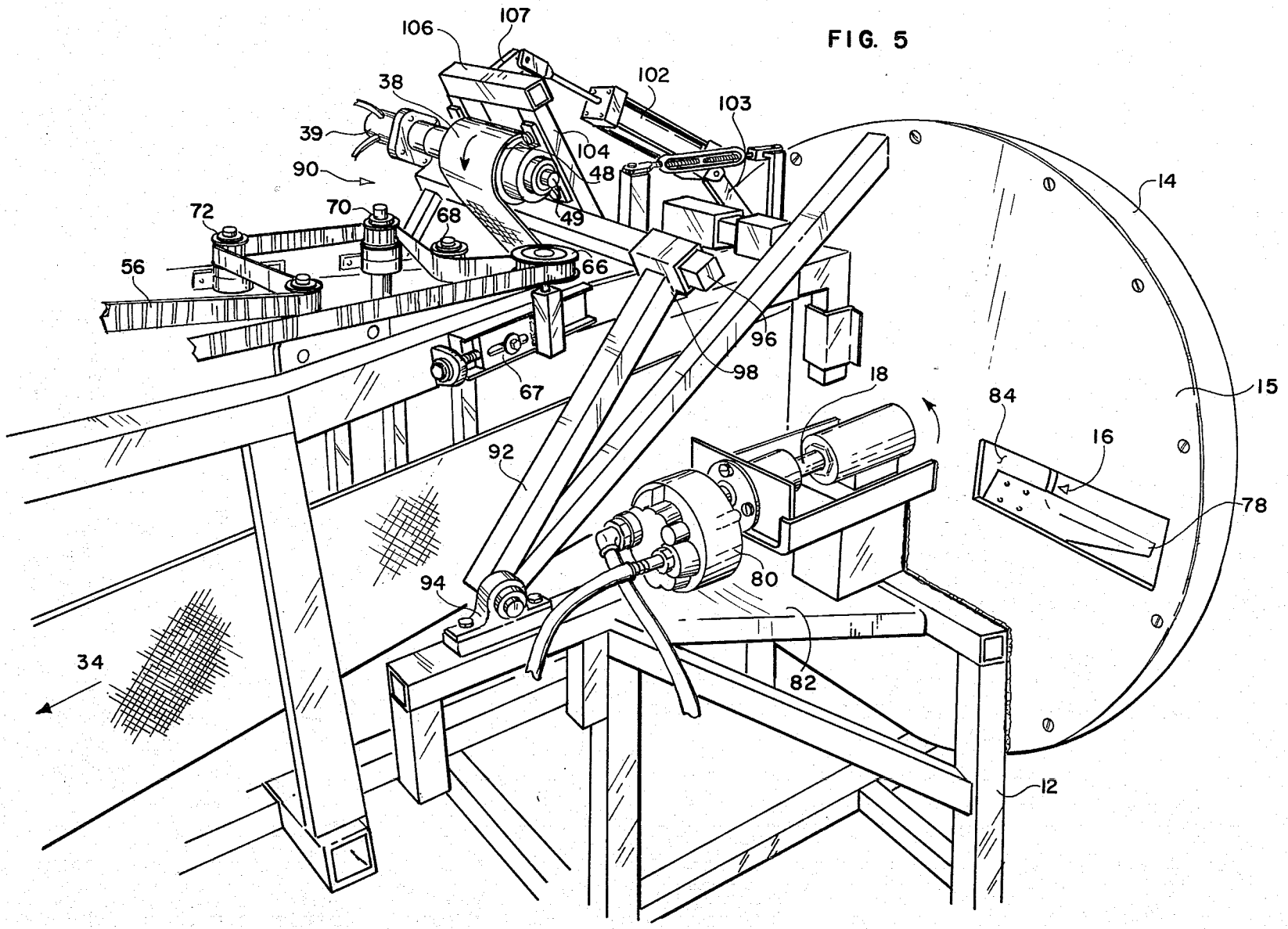
FIG. 5 is a perspective view, also from the front of the machine, revealing the drive arrangement for the high speed cutter, as well as the pivotally mounted yoke arrangement making it possible for the upper belt to apply a desirable amount of compressive force to the vegetables to be sliced.

Turning now to FIG. 5, it will be seen that this figure reveals the portion of my device on the other side of circular housing 14 from the openings 20 and 24, with this view depicting a preferred arrangement for driving the cutter 16 in rotation. Although I am not to be so limited, I prefer to use a hydraulic motor 80 for driving the cutter in rotation, which motor is supported by a plate 82 that is in turn supported by framework 12. The cutter 16 is, of course, operatively disposed in the circularly-shaped vertically disposed housing 14, which cutter is mounted upon the shaft 18, as previously discussed. I typically arrange the output shaft of the motor 80 to connect directly to the end of shaft 18 remote from the cutter, but other suitable arrangements may be preferred.

The cutter 16 is represented in FIG. 5 by blade 78, which may be one of a plurality of blades secured to the drum portion 76 of the cutter. Aperture 84 on the rear side of the circular housing is of sufficient size as to afford access to the blades 78 for maintenance, rearrangement, and replacement, where necessary. In the interests of safety, I typically utilize a door in connection with aperture 84, with which an interlock is utilized. The interlock arrangement is such that power must be removed from the machine before the door can be opened.

It will be noted that the cutter drive arrangement is disposed alongside the "return" side of belt 34 which side is, of course, traveling from right to left as viewed in this figure. Also visible in this figure is a portion of upper belt 38, the arrangement that drives this belt, and the arrangement that enables this belt to play a role in the compressing and packing of the celery or other vegetable traveling along the belt 36, which vegetable has, as previously mentioned, already been compressed in a sideways sense by the vertically upstanding belts 32 and 34.

Figure 6:
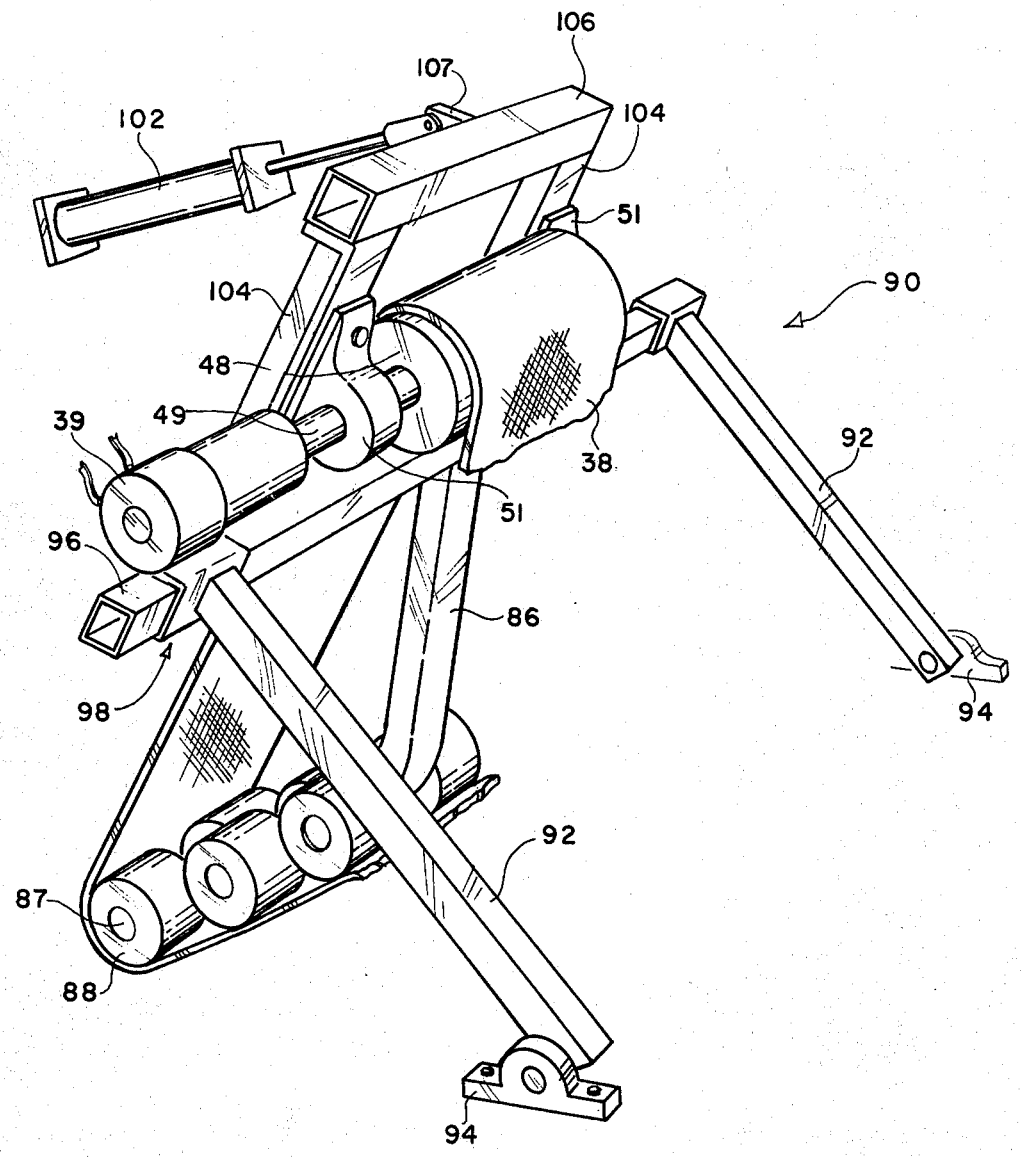
FIG. 6 is a perspective view of the yoke arrangement to a larger scale to reveal other details of the arrangement for driving and supporting the upper belt.

The driving drum 48 associated with upper belt 38 is driven by hydraulic motor 39 in the counterclockwise direction as viewed in FIG. 5, which is the clockwise direction as viewed in FIG. 6. Drum 48 is mounted on a shaft 49 that is mounted in a pair of pillow block bearings 51, each of which is in turn bolted to a framework 90 that is pivotally mounted on a suitable portion of framework 12.

Figure 7:
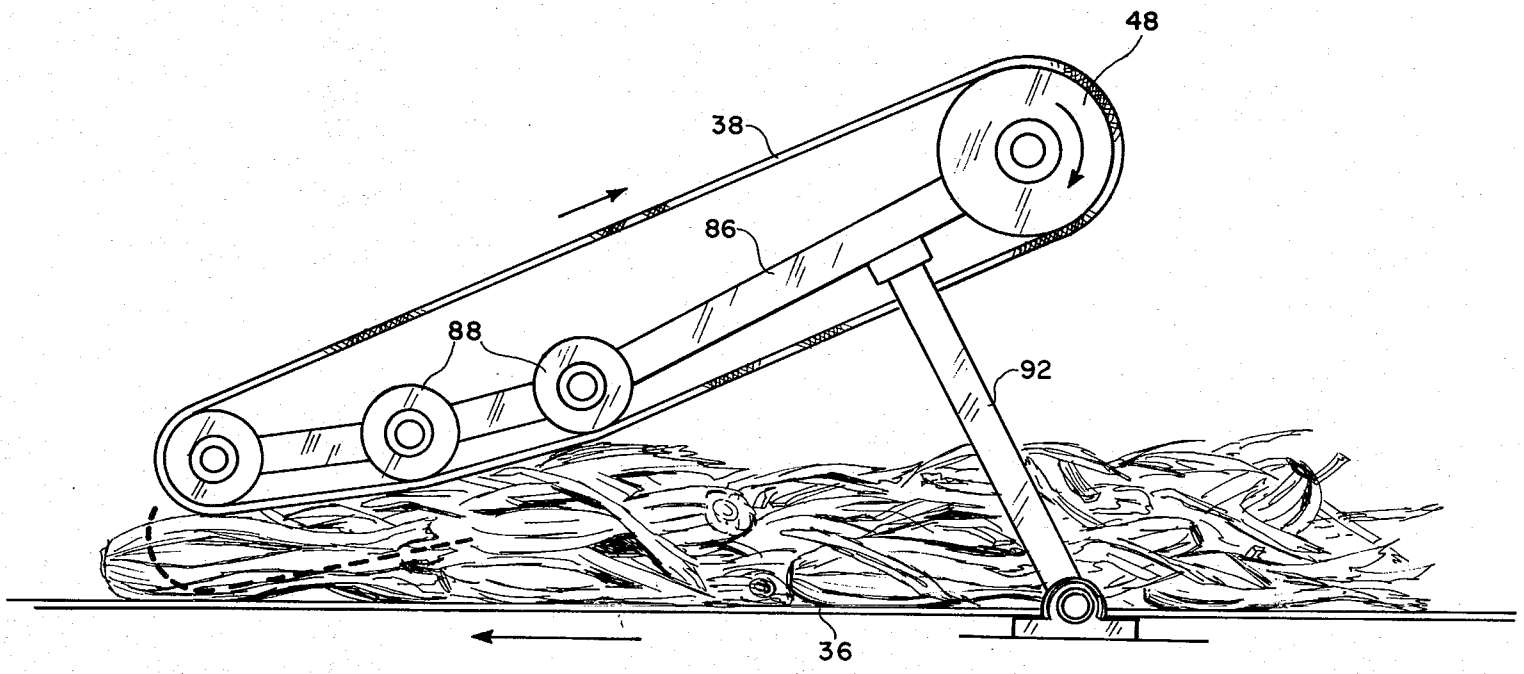
FIG. 7 is a side elevational view of the upper belt arrangement.

As revealed in FIGS. 5, 6 and 7, the framework 90 utilized for supporting the upper belt is principally formed by a plurality of rigid members, these including a pair of essentially parallel arms 92, with one being disposed on each side of the belts; a horizontally disposed member 96 to which the upper ends of the arms are secured; and a curved member 86 extending downwardly from the central portion of the member 96, in fixed relation to the arms 92 as viewed in FIG. 7.

The arms 92 and the member 96 are, for example, made of square steel tubing, with the arms being say 19 inches long, and the member 96 say 27 inches long. This latter dimension is great enough that the yoke 98 defined by the arms 92 and the member 96 can span the belts 32, 34, 36 and 38; note FIG. 5 in this regard.

As perhaps best seen in FIGS. 5 and 6, the yoke 98 is movable in a pivoted sense by virtue of the fact that the lower ends of arms 92 are pivotally mounted in pillow block bearings 94 that are in turn mounted on the framework 12. The motion of the yoke about the bearings 94 is modified by an air shock absorber 102, as discussed hereinafter. On each side of the approximate center point of the member 96 is secured a short structural member 104, with this pair of members serving as a support for the pillow block bearings 51 in which the shaft 49 of driving drum 48 is rotatably disposed. Across the top of the members 104 is welded or otherwise secured a short structural member 106. At the center point location of member 106 is a pivotal member 107, to which the upper end of the air shock absorber 102 attaches.

FIGS. 6 and 7 reveal that mounted at spaced locations along the lower curved portion of member 86 are a plurality of rollers or wheels 88 that are contacted by the inside portion of the upper belt 38. This is to say, as the belt is driven in rotation by the upper drum 48 as a result of the efforts of the motor 39, the positioning of the rollers 88 cause the belt 38 to take on the desired configuration shown in these two figures.

As a result of this arrangement, as the stalks of celery move from right to left on belt 36 in the manner shown in FIG. 7, these stalks pass under the moving belt 38, with the bulk of the celery in many instances causing the entire yoke assembly to lift in the direction away from the belt 36. Because of the rigid relationship that exists between the member 86 and the pair of arms 92, the passage of celery below the wheels 88 causes the member 86 to lift upwardly, and accordingly the arms to rotate about the pillow block bearings 94. After a quantity of celery has passed by, the yoke assembly 98 can return to its normal position, which is close to the belt 36 but spaced therefrom, as depicted by the dashed lines in FIG. 7.

The previously mentioned air shock absorber 102 prevents yoke bounce, as would otherwise occur if a quantity of celery suddenly was presented. The upper end of device 102 is connected to the member 106, as previously mentioned, whereas the lower end is supported by a member 103, as revealed in FIG. 5. Therefore, as the member 86 is caused to lift by a quantity of celery carried by the belt 36, the shock absorber 102 resists this motion, but it permits the yoke to immediately drop after the quantity of celery has passed by. The device 102 does not apply force as such, for the weight of the belt and driving assembly is sufficient to give a desirable amount of compression to the celery, but the device 102 does serve to hold and compress the celery in the proper manner for cutting.

Figure 8:
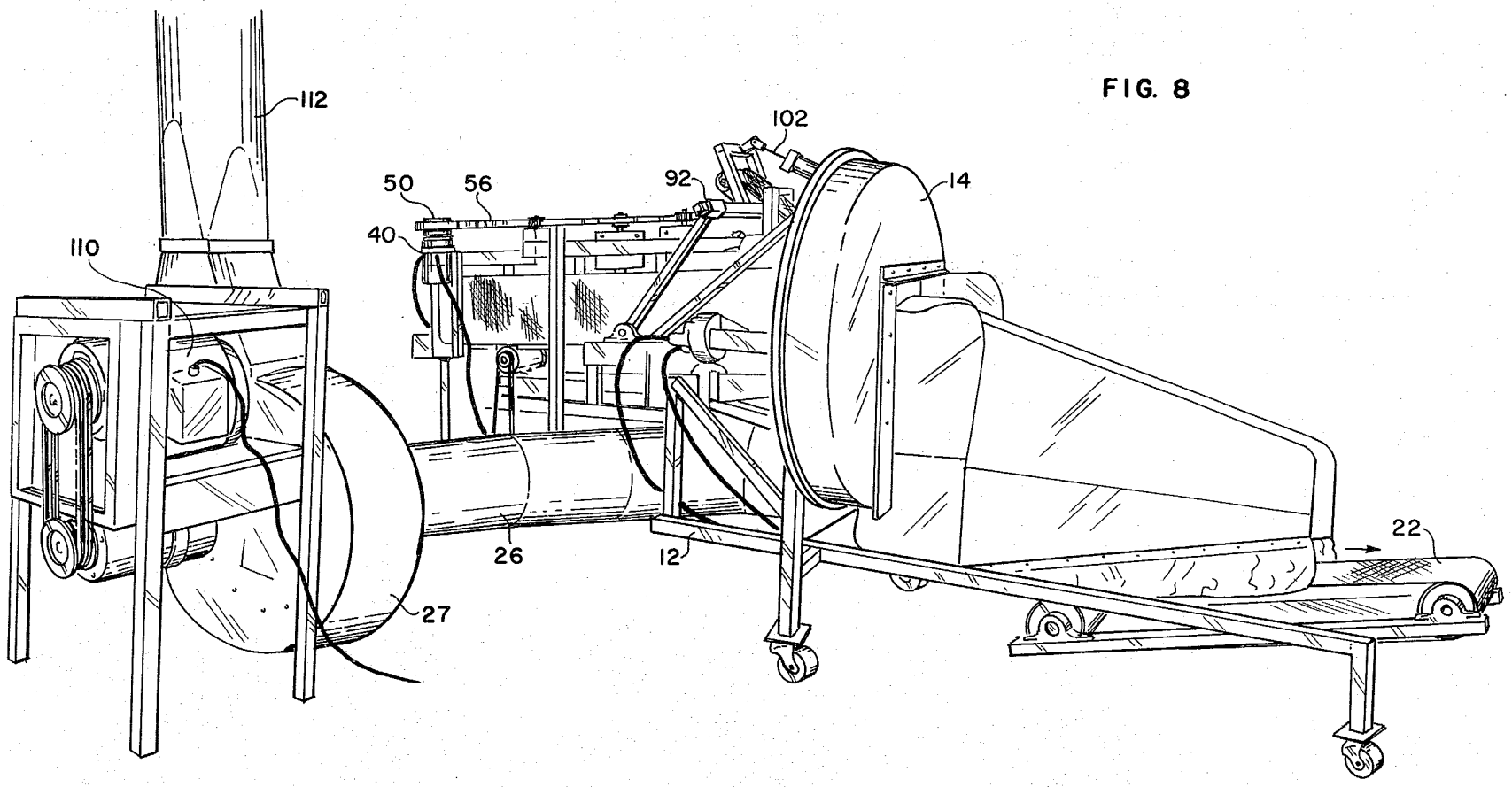
FIG. 8 is a perspective view from the rear quarter of the machine, revealing the relationship of cutter, endless belts, and trash removal arrangements.

Turning now to FIG. 8, it will be seen from this view that I provide a comparatively large duct 26 leading away from the front side of the machine, which of course carries off the leaves and other debris entering aperture 24 illustrated in FIG. 1. The outer end of duct 26 attaches to a fan housing 27 in which a large blower fan (not shown) is operatively mounted. This fan is, of course, driven in rotation by a large electric motor 110 which serves to cause the debris to be pulled through the duct 26 at a substantial rate, and to cause such debris then to exit through a duct 112. This view also reveals more about the moving mesh belt 22 utilized for carrying the cut up pieces of celery to a point of use, as well as other relevant portions of my machine.

Figure 9:
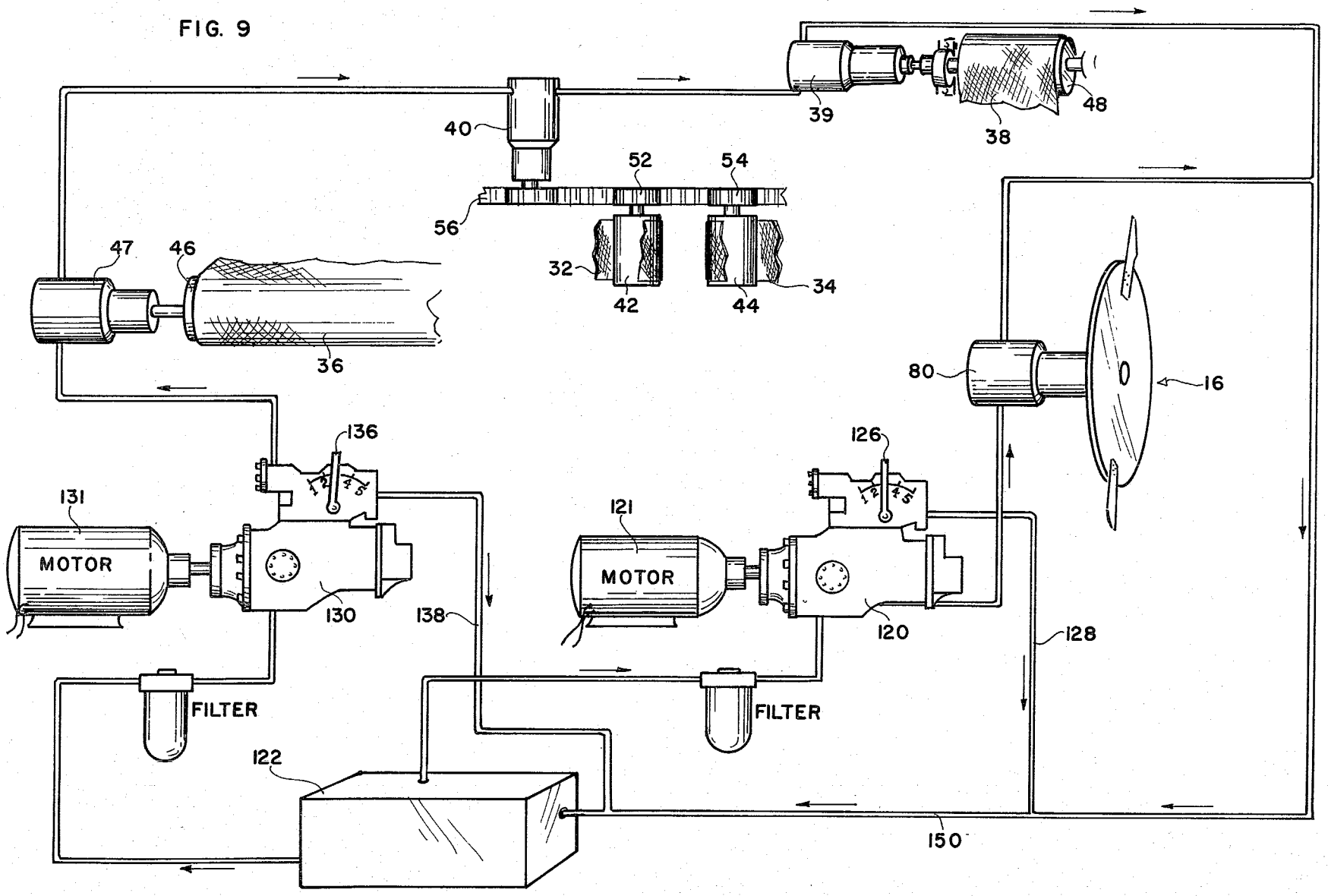
FIG. 9 is a simplified view of the hydraulic arrangement I utilize for the selective operation of the hydraulic motors.

Turning to FIG. 9, it will be seen that I have schematically depicted the hydraulic arrangement I prefer for use in connection with the drive motors associated with the belts, and the hydraulic arrangement utilized for driving the cutter blade in rotation. The variable displacement pump 120 receives fluid from the sump 122, with the outlet of the pump being connected to cutter motor 80. Fluid passing through the motor 80 drives the cutter assembly 16 in rotation and thereafter returns to the sump so as to be available to be recirculated. Inasmuch as it is desirable to be able to vary the speed of the cutter, I provide a lever arrangement 126 that is operatively connected to the variable displacement pump, which lever may have a number of operative positions represented by the numbers 1 through 5. Quite obviously, if the operator wished to increase the speed of the cutter, he would move the lever in the direction of a higher number so as to cause a larger amount of oil to pass through the cutter motor 80 and thus increase its speed, or alternatively, he would move the lever in the direction of a lower number if he wished to bring about a diminished speed, this of course being accomplished as a result of less oil passing through the motor.

Similarly, a variable displacement pump 130 is utilized for supplying suitable quantities of oil to the three hydraulic motors utilized for driving the belts 32, 34 and 36. As in the previous instance, the variable displacement pump obtains oil from a sump, such as sump 132, and into this sump flows the hydraulic oil after it has passed through all three belt motors.

A handle 136 is operatively associated with the variable displacement pump 130, and this handle, like the handle 126, is movable to a number of different operative positions so that the operator can cause the belts to move at the desired speed.

By virtue of the arrangement depicted in FIG. 9, wherein all three belt motors 39, 40 and 47 utilize the same oil, the four belts driven by these three motors are caused to move at the same speed, or number of feet per minute, which of course is preferable insofar as the compressing of the celery is concerned.

By virtue of the calibrated scales associated with the handles 126 and 136, the operator can match the cutter speed with the belt speed that is desirable in a given circumstance. As pointed out hereinbefore, it may in some instances be desired to cut the celery into very small pieces or in very long pieces, or in pieces of intermediate length. The relationship of belt and cutter speeds to give pre-established celery sizes is as follows:

| Belt Speed | No. Blades | Blade RPM | Result |
|---|---|---|---|
| 133 fpm | 2 | 200 | 4" pieces |
| 133 fpm | 6 | 532 | ½" pieces |
| 133 fpm | 6 | 638 | ¼" pieces |
| 266 fpm | 2 | 400 | 4" pieces |

I claim:

1. A machine for cutting up elongate vegetables on a rapid, high volume basis comprising a first endless moving belt of substantial length, at a first location on which belt, vegetables to be cut or sliced can be deposited for transport to a second location, second and third endless moving belts of similar length disposed adjacent the sides of said first belt and serving to keep vegetables supported by said first mentioned belt from falling off the edges thereof, said second and third belts being disposed in a converging relationship in the direction of movement, so as to narrow the width of the space in which vegetables residing on said first belt can be accommodated, an upper endless moving belt extending over at least part of the length of said first belt and serving with said second and third belts to compress the vegetables on said first belt into a closely packed mass by the time the second location has been reached, and a rapidly rotating cutter blade means operative adjacent said second location for acting upon and slicing the vegetables compressed by said belt array.

2. The machine as defined in claim 1 in which means are provided for selectively regulating the speed of said cutter blade means with relation to the speed of said belts so as to enable the vegetables to be cut into pieces of preascertained and essentially consistent length.

3. The machine as defined in claim 2 in which the number of blades utilized on said cutter blade means can be changed.

4. The machine as defined in claim 2 in which trash removal means are provided adjacent said second location.

5. A device for cutting up compressible items at a high volume rate into pieces of a desired size, comprising a plurality of endless moving belts disposed in a cooperative and convergent relationship, which belts are arranged to bring about compression of such items from essentially orthogonal directions, one of said moving belts being arranged to receive quantities of such items at a first location, to support said items and to transport same to a second location, a second of said belts being disposed above said one belt and applying downward force during belt movement such that the items are compressed between the pair of belts, additional compression means for bringing about compression in a direction essentially orthogonal to the direction of compression between said first and second belts, said additional compression means including a third moving belt, the efforts of the several belts thereby causing the compressible items to become a highly compacted mass as a result of compression from the two essentially orthogonal directions, and high capacity rotary cutter means operatively disposed adjacent said second location, said cutter means being operative in a plane substantially perpendicular to the direction of motion of said first belt, said cutter means acting upon and cutting up the compressible items into pieces of small size.

6. The device as defined in claim 5 in which said belts for applying pressure also serve at the same time to bring about a desired alignment of the items, in the event elongate items are being cut up.

7. The device as defined in claim 5 in which the speed of said high capacity cutter means and the speed of said endless belts are relatively adjustable, thus to make possible the cutting of the items into small pieces of selected size.

8. The device as defined in claim 5 in which said high capacity cutter means involves a rapidly rotatable circular member, upon the periphery of which, one or more essentially straight cutting blades are disposed.

* * * * *